US006897759B2

(12) United States Patent
Lee

(10) Patent No.: US 6,897,759 B2
(45) Date of Patent: May 24, 2005

(54) HIGH VOLTAGE TRANSFORMER

(75) Inventor: Kil Young Lee, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 58 days.

(21) Appl. No.: 10/440,130

(22) Filed: May 19, 2003

(65) Prior Publication Data

US 2004/0145444 A1 Jul. 29, 2004

(30) Foreign Application Priority Data

Jan. 27, 2003 (KR) ..... 10-2003-0005180

(51) Int. Cl.[7] ..... H01F 27/30
(52) U.S. Cl. ..... 336/206; 336/212
(58) Field of Search ..... 336/212, 234, 336/206

(56) References Cited

U.S. PATENT DOCUMENTS 4,804,340 A * 2/1989 Hamer et al. ..... 439/709
6,087,922 A * 7/2000 Smith ..... 336/223
6,114,935 A * 9/2000 Oosuka et al. ..... 336/107
6,144,282 A * 11/2000 Lee ..... 336/234
6,414,291 B1 * 7/2002 Kim ..... 219/760

FOREIGN PATENT DOCUMENTS

JP 08-051032 2/1996

* cited by examiner

*Primary Examiner*—Anh Mai
(74) *Attorney, Agent, or Firm*—Staas & Halsey LLP

(57) ABSTRACT

A high voltage transformer includes an E-shaped core having grooves into which electrical parts are inserted, an I-shaped core supporting the E-shaped core, and an insulating element inserted between the E-shaped core and the I-shaped core to insulate the electrical parts. The electrical parts are primarily insulated by the insulating element inserted into the transformer, so that a conventional insulation process may be shortened. Additionally, low-cost insulating papers may be used to insulate the electric parts, so that the manufacturing cost of the transformer may be reduced.

25 Claims, 3 Drawing Sheets

HIGH VOLTAGE TRANSFORMER

CROSS-REFERENCE TO RELATED APPLICATIONS

This application claims the benefit of Korean Patent Application No. 2003-5180, filed Jan. 27, 2003, in the Korean Intellectual Property Office, the disclosure of which is incorporated herein by reference.

BACKGROUND OF THE INVENTION

1. Field of the Invention

The present invention relates, in general, to a high voltage transformer and, more particularly, to a high voltage transformer having improved insulating construction.

2. Description of the Related Art

A high voltage transformer is a device that functions to boost an input voltage supplied from an external power supply to a high voltage and output the boosted voltage. The high voltage transformer is generally used in electronic products, such as a microwave oven.

The high voltage transformer is manufactured by joining a laminated E-shaped core, in which a plurality of E-shaped iron cores are laminated, with a laminated I-shaped core, in which a plurality of I-shaped iron cores are laminated, and disposing electrical parts, such as a primary coil, a secondary coil, pass cores and a heater coil, between the laminated E-shaped core and the laminated I-shaped core.

Meanwhile, the electrical parts disposed between the laminated E-shaped and I-shaped cores must be insulated from the laminated the E-shaped and I-shaped cores. However, an insulation process of surrounding the electrical parts, such as the primary coil and the secondary coil, with insulating papers is carried out by hand, so that a number of operations are involved and the manufacturing time of the high voltage transformer is therefore increased.

Additionally, NOMEX papers are used as the insulating papers that insulate the electric parts from the laminated E-shaped and I-shaped cores. The NOMEX papers have good insulation properties, but they are expensive. Accordingly, the manufacturing cost of the high voltage transformer is increased.

Particularly, since the secondary coil is dually surrounded by a NOMEX paper and a mica sheet to be insulated from the cores, the manufacturing cost of the high voltage transformer is increased.

Meanwhile, low-cost insulating papers are not used in the conventional transformer until the insulating construction of the conventional high voltage transformer is improved. That is, in the case where low-cost insulating papers are used in the conventional transformer without an improved insulating construction, the high voltage transformer may malfunction.

Additionally, a terminal unit is formed using an insulating paper to connect electrical parts to an external power supply, so that the manufacturing efficiency of the conventional transformer productivity is reduced.

SUMMARY OF THE INVENTION

Accordingly, it is an aspect of the present invention to provide a high voltage transformer in which insulating construction thereof is improved, thus reducing the number of the manufacturing operations and manufacturing cost thereof.

Additional aspects and/or advantages of the invention will be set forth in part in the description which follows and, in part, will be obvious from the description, or may be learned by practice of the invention.

The foregoing and/or other aspects of the present invention are achieved by providing a high voltage transformer including an E-shaped core having grooves into which electrical parts are inserted, an I-shaped core supporting the E-shaped core, and an insulating element inserted between the E-shaped core and the I-shaped core to insulate the electrical parts.

The insulating element may comprise a resin with electrical insulation properties and heat resistance.

In one aspect, the insulating element may comprise Poly Butylene Terephthalate (PBT) resin.

The insulating element may conform to shapes of the grooves in order to surround the electrical parts.

In addition, the insulating element may have channels into which the electrical parts are inserted.

Additionally, the high voltage transformer may further include one or more press boards used as insulating papers to insulate the electrical parts.

The insulating papers may surround the electrical parts inserted into the grooves of the E-shaped core.

Each pair of the insulating papers may be inserted between one of the electrical parts inserted into the grooves of the E-shaped core and another electrical part.

Additionally, the insulating element may be integrated with a terminal unit that connects the electrical parts to an external power supply.

One or more fixing holes, which fix one or more terminals connected to the electrical parts, may be formed in the terminal unit.

In addition, the electrical parts may include a primary coil, a secondary coil, a heater coil and pass cores.

BRIEF DESCRIPTION OF THE DRAWINGS

The above and/or other aspects and advantages of the present invention will become apparent and more appreciated from the following detailed description of the preferred embodiments, taken in conjunction with the accompanying drawings of which.

DETAILED DESCRIPTION OF THE PREFERRED EMBODIMENTS

Figure 1:
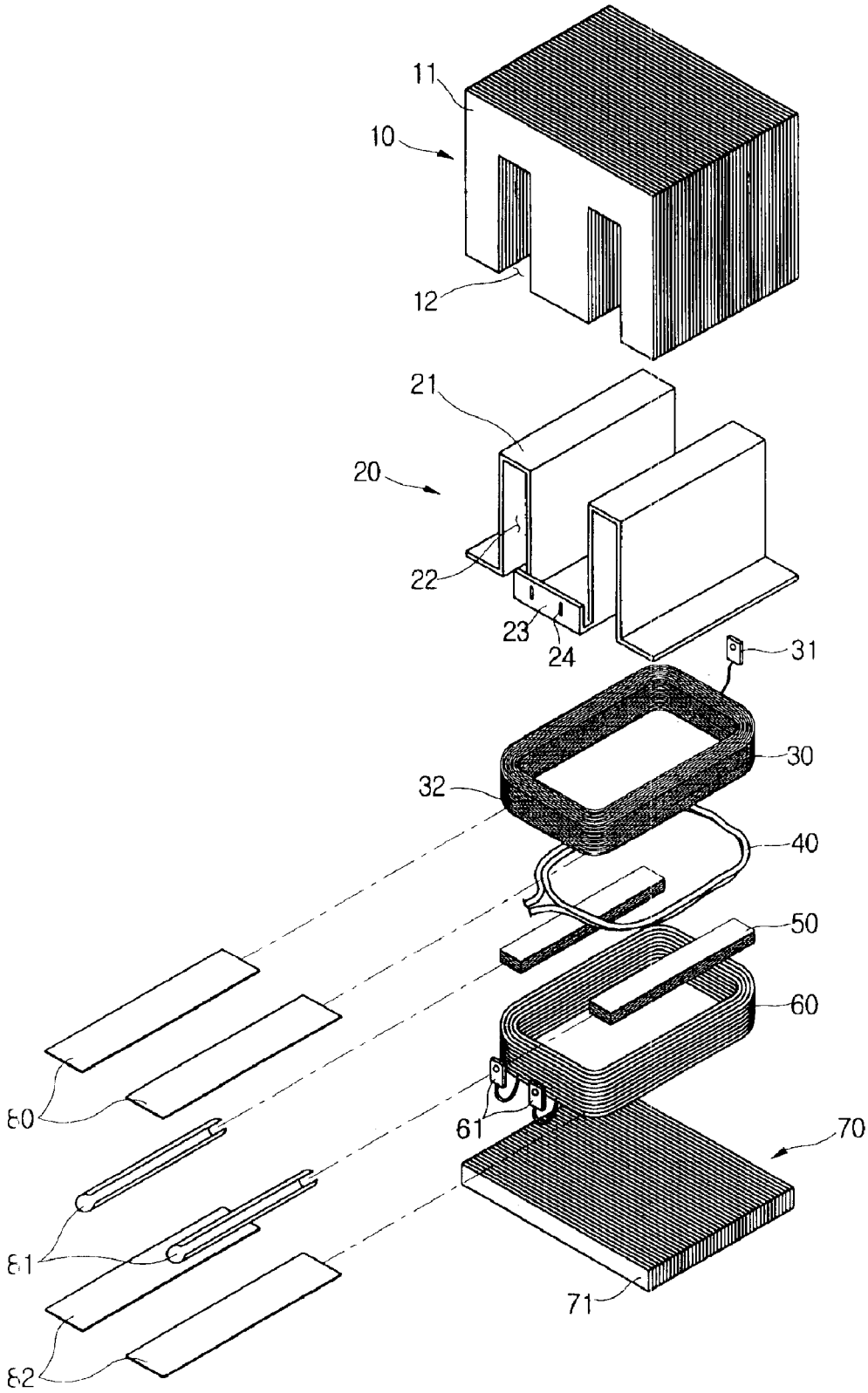
FIG. 1 is an exploded perspective view of a high voltage transformer, according to an embodiment of the present invention.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Figure 2:
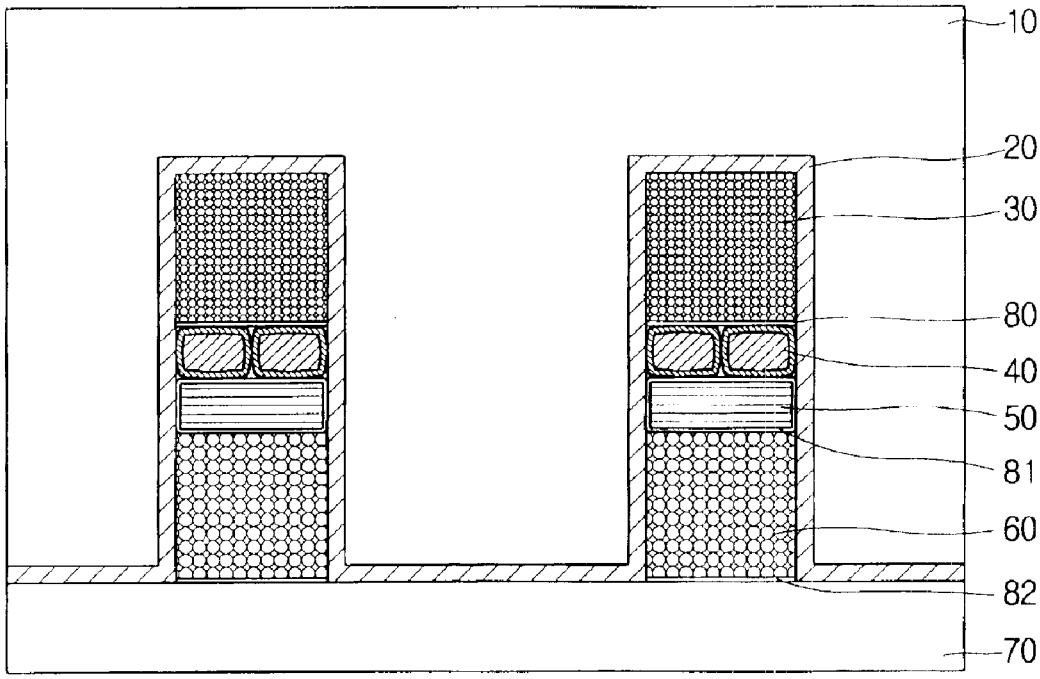
FIG. 2 is a sectional view of the high voltage transformer of FIG. 1.
Figure 3:
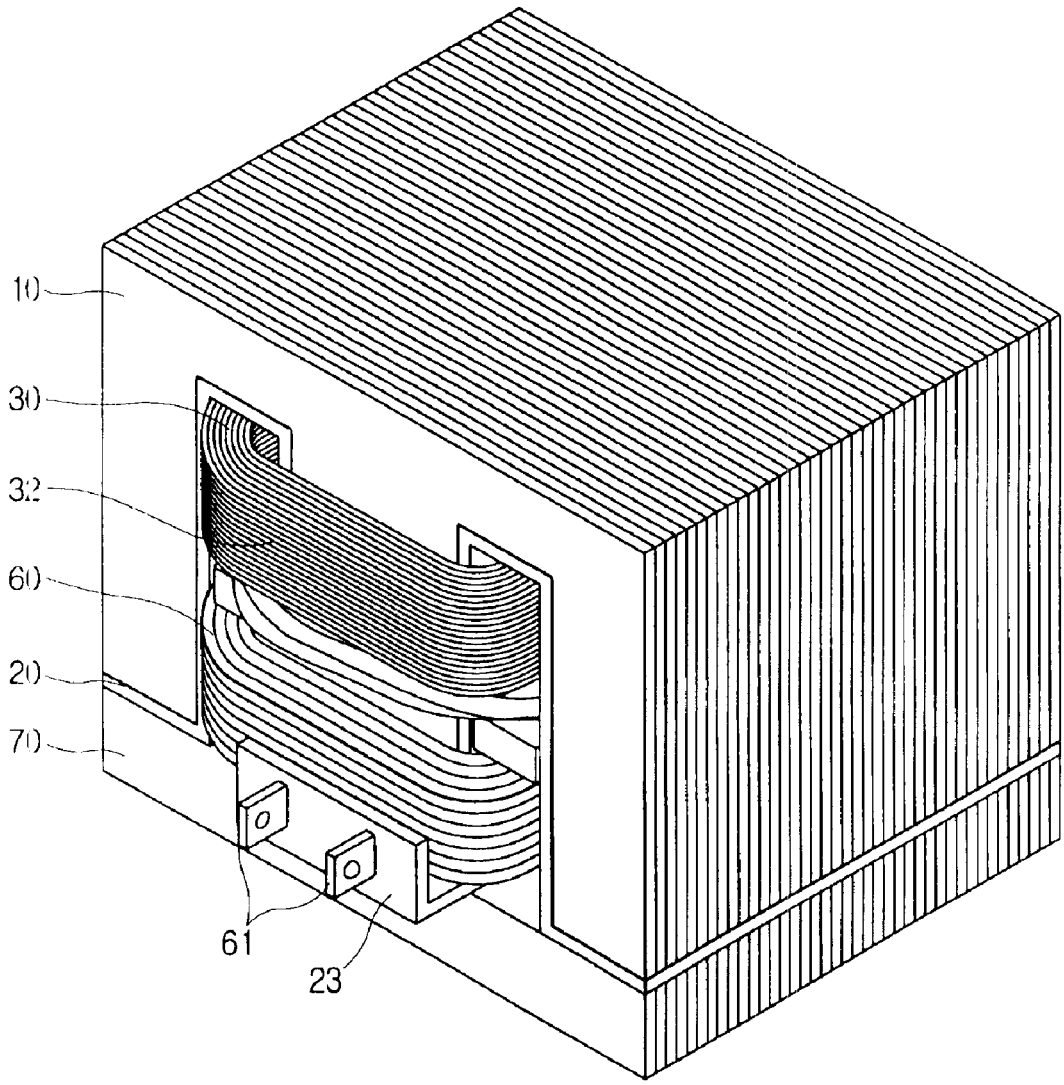
FIG. 3 is a perspective view of the high voltage transformer of FIG. 1.

FIG. 1 is an exploded perspective view of a high voltage transformer, according to an embodiment of the present invention. FIG. 2 is a sectional view of the high voltage transformer of FIG. 1. FIG. 3 is a perspective view of the high voltage transformer of FIG. 1.

Referring to FIG. 1, a laminated E-shaped core 10 is formed by laminating a plurality of E-shaped iron cores 11, and a laminated I-shaped core 70 is formed by laminating a plurality of I-shaped iron cores 71.

An insulating element 20 is inserted between the laminated E-shaped core 10 and the laminated I-shaped core 70, and then electrical parts which are used to generate a high voltage, including a secondary coil 30, a heater coil 40, pass cores 50 and a primary coil 60, are inserted between the laminated E-shaped core 10 and the laminated I-shaped core 70. At this time, an insulating paper 80 is inserted between each of the lateral portions of the secondary coil 30 and each of lateral portions of the heater coil 40. An insulating paper 81 surrounds each of the pass cores 50 positioned below each of the lateral portions of the heater coil 40, and an insulating paper 82 is inserted between each of the lateral portions the primary coil 60 and each of lateral portions of the laminated I-shaped core 70.

The insulating element 20 is formed by casting resin having electrical insulation properties and heat resistance. In an embodiment of the present invention, a Poly Butylene Terephthalate (PBT) resin may be used to fabricate the insulating element 20.

The insulating element 20 is formed to conform to the shapes of grooves 12 of the laminated E-shaped core 10 to partially surround the electrical parts. Upper surfaces 21 of the insulating element 20 protrude to contact the grooves 12. The electrical parts, including the second coil 30, the heater coil 40, the pass cores 50 and the primary coil 60, are inserted into channels 22 of the insulating element 20.

Accordingly, the insulating element 20 surrounds the lateral portions of the secondary coil 30, the heater coil 40, the primary coil 60, and the pass cores 50 so that the electrical parts are primarily insulated.

Low-cost press boards formed of compressed papers are used as the insulating papers 80, 81 and 82 to insulate electrical parts, which is possible because the electrical parts are primarily insulated by the insulating element 20. Accordingly, the use of high-cost NOMEX papers is unnecessary in this case.

Additionally, the insulating element 20 is provided with a first terminal unit 23 that connects the electrical parts to an external power supply. The first terminal unit 23 is formed by extending a lower portion of the insulation element 20 forward and bending it vertically from the front edge of the insulating element 20.

Fixing holes 24 are formed in the first terminal unit 23 to fix first terminals 61 connected to the primary coil 60, and the first terminals 61 are inserted into the fixing holes 24. The first terminals 61 are connected to the external power supply and supply an input voltage to the primary coil 60.

Although not shown in the drawings, a secondary terminal unit, which fixes a second terminal 31 connected to the secondary coil, is disposed in the back of the insulating element 20, and the second terminal 31 is fixed to the secondary terminal unit so that a boosted voltage may be output therethrough.

Referring to FIG. 2, the insulating element 20 surrounds the lateral portions of the secondary coil 30, the heater coil 40, the primary coil 60, and the pass cores 50, which are inserted into the channels 22, and has electrical insulation properties and heat resistance, so that the electrical parts may be primarily insulated. For example, straight lateral portions of the secondary coil 30 surrounded by the insulating element 20 need not be surrounded by insulating papers. For this reason, a conventional insulation process may be shortened, so that the number of the manufacturing operations and manufacturing time of the transformer may be decreased.

Meanwhile, portions of the electrical parts exposed outside the insulating element 20, for example, curved front and rear portions 32 of the secondary coil 30, are exposed outside the insulating element 20 and not surrounded by the insulating element 20, so that the curved front and rear portions 32 of the secondary coil 30 are insulated by being surrounded by insulating papers.

As is apparent from the above description, the present invention provides a high voltage transformer, in which electrical parts are primarily insulated by an insulating element inserted into the transformer, so that an insulation process of surrounding electrical parts with insulating papers by hand may be shortened, thus decreasing the number of the manufacturing operations and manufacturing time of the transformer. Additionally, the present invention provides a high voltage transformer in which terminal units are integrated with the insulating element, thus eliminating a process of forming terminal units using insulating papers. Additionally, the present invention provides a high voltage transformer in which low-cost press boards are used as insulating papers to insulate electrical parts, thus reducing the manufacturing cost of the transformer. In addition, the E-shaped coil may be a notched coil.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A high voltage transformer, comprising:

an E-shaped core having grooves into which electrical parts are inserted;

an I-shaped core supporting the E-shaped core; and an insulating element inserted between the E-shaped core and the I-shaped core to insulate the electrical parts, wherein the electrical parts include a primary coil, a secondary coil, a heater coil and pass cores.

2. The high voltage transformer as set forth in claim 1, wherein the insulating element is made of a resin with electrical insulation properties and heat resistance.

3. The high voltage transformer as set forth in claim 2, wherein the insulating element is made of Poly Butylene Terephthalate (PBT) resin.

4. The high voltage transformer as set forth in claim 1, wherein the insulating element conforms to shapes of the grooves to surround the electrical parts.

5. The high voltage transformer as set forth in claim 4, wherein the insulating element has channels into which the electrical parts are inserted.

6. The high voltage transformer as set forth in claim 1, further comprising at least one press board to insulate the electrical parts.

7. The high voltage transformer as set forth in claim 1, further comprising insulating papers that surround the electrical parts inserted into the grooves of the E-shaped core.

8. The high voltage transformer as set forth in claim 7, wherein each pair of the insulating papers is inserted between one of the electrical parts inserted into the grooves of the E-shaped core and another electrical part.

9. The high voltage transformer as set forth in claim 7, wherein the insulator has channels into which the electrical parts are inserted.

10. The high voltage transformer as set forth in claim 1, further comprising a terminal unit integrated with the insulating element, wherein the terminal unit connects the primary coil to an external power supply.

11. The high voltage transformer as set forth in claim 10, wherein at least one fixing hole, which fixes one or more terminals connected to the electrical parts, is formed in the terminal unit.

12. The high voltage transformer as set forth in claim 10, wherein the insulating element is further integrated with another terminal unit that connects a secondary coil to another external power supply.

13. A high-voltage transformer, comprising:

a notched core-insulator-flat core combination, wherein electrical parts are inserted into notches of the notched core, wherein the electrical parts include a primary coil, a secondary coil, a heater coil and pass cores.

14. The high-voltage transformer as set forth in claim 13, wherein the notched core and the flat core comprise iron.

15. The high-voltage transformer as set forth in claim 14 wherein the notched core and the flat core are laminated.

16. The high voltage transformer as set forth in claim 13, wherein the insulator is made of Poly Butylene Terephthalate (PBT) resin.

17. The high voltage transformer as set forth in claim 13, wherein the insulator conforms to shapes of the notches to surround the electrical parts.

18. The high voltage transformer as set forth in claim 13, wherein the insulator is made of a resin with electrical insulation properties and heat resistance.

19. The high voltage transformer as set forth in claim 13, further comprising at least one press board to insulate the electrical parts.

20. The high voltage transformer as set forth in claim 13, further comprising insulating papers that surround the electrical parts inserted into the notches of the notched core.

21. The high voltage transformer as set forth in claim 20, wherein each pair of the insulating papers is inserted between one of the electrical parts inserted into the notches of the notched core and another electrical part.

22. The high voltage transformer as set forth in claim 13, further comprising a first terminal unit integrated with the insulator, wherein the terminal unit connects the primary coil to an external power supply.

23. The high voltage transformer as set forth in claim 22, wherein at least one fixing hole, which fixes one or more terminals connected to the electrical parts, is formed In the terminal unit.

24. The high voltage transformer as set forth in claim 22, further comprising a second terminal unit that connects a secondary coil to another external power supply.

25. The high voltage transformer as set forth in claim 13, further including insulating papers surrounding a curved front portion and a curved rear portion of the secondary coil.

* * * * *

UNITED STATES PATENT AND TRADEMARK OFFICE

CERTIFICATE OF CORRECTION

PATENT NO. : 6,897,759 B2
DATED : May 24, 2005
INVENTOR(S) : Kil Young Lee

It is certified that error appears in the above-identified patent and that said Letters Patent is hereby corrected as shown below:

Column 6,
Line 19, replace "In" with -- in --.

Signed and Sealed this

Thirty-first Day of January, 2006

JON W. DUDAS
*Director of the United States Patent and Trademark Office*